US005602372A

United States Patent [19]

Strelow

[11] Patent Number: 5,602,372

[45] Date of Patent: Feb. 11, 1997

[54] DIFFERENTIAL PRESSURE FLOW SENSOR

[75] Inventor: John L. Strelow, Broken Arrow, Okla.

[73] Assignee: Oklahoma Safety Equipment Co., Broken Arrow, Okla.

[21] Appl. No.: 566,403

[22] Filed: Dec. 1, 1995

[51] Int. Cl.[6] ..... H01H 35/40

[52] U.S. Cl. ..... 200/81.9 R

[58] Field of Search ..... 73/861.47, 709, 73/861.52; 200/81.9 R; 340/611

[56] References Cited

U.S. PATENT DOCUMENTS

| | | | |
|---|---|---|---|
| Re. 34,308 | 7/1993 | Thompson et al. | 340/679 |
| 1,641,196 | 9/1927 | Roucka . | |
| 2,276,100 | 3/1942 | Scholin | 200/81.9 R |
| 2,347,830 | 5/1944 | Kiburz et al. | 200/81.9 R |
| 2,408,685 | 10/1946 | Rosenberger | 73/407 |
| 2,561,700 | 7/1951 | Hughes . | |
| 3,296,868 | 1/1967 | Koppel et al. | 73/407 |
| 3,304,779 | 2/1967 | Reed | 73/205 |
| 3,536,873 | 10/1973 | Miller et al. | 200/81.9 R |
| 3,770,918 | 11/1973 | Fortmann | 200/61.08 |
| 3,802,265 | 4/1974 | Wood | 73/211 |
| 4,249,164 | 2/1981 | Tivy | 340/870.3 |
| 4,270,560 | 6/1981 | Kearney | 137/68 R |
| 4,342,988 | 8/1982 | Thompson et al. | 340/679 |
| 4,408,194 | 10/1983 | Thompson | 340/626 |
| 4,791,414 | 12/1988 | Griess | 340/606 |
| 4,951,697 | 8/1990 | Fritts | 137/68.1 |
| 4,978,947 | 12/1990 | Finnegan | 340/611 |
| 5,155,471 | 10/1992 | Ellis et al. | 340/611 |
| 5,162,624 | 11/1992 | Duksa | 100/81.9 M |

*Primary Examiner*—Richard Chilcot
*Assistant Examiner*—Jewel Artis
*Attorney, Agent, or Firm*—Jones, Day, Reavis & Pogue

[57] ABSTRACT

A "slip-joint" type of sensor having a tab design consisting of a unique shape which permits easy manufacture, low resistance to sliding forces, and reliable electrical contact. The unique switch or tab and body design provides positive electrical contact without the need for costly, full diameter, annular sheet metal rings. The sensor body lies in a single common plane and may have a variety of shapes depending on the flow rate to be permitted without tripping the sensor. The sensor may be hermetically sealed by a thin-film polymer liner to permit no flow through the sensor without a signal. The liner may be on either or both sides of the sensor. This design permits use of the liner designed to withstand a static pressure without bursting. At the static pressure, however, the liner will be deformed sufficiently to trip the sensor.

15 Claims, 4 Drawing Sheets

DIFFERENTIAL PRESSURE FLOW SENSOR

BACKGROUND OF THE INVENTION

1. Field of the Invention

The present invention relates generally to differential pressure flow sensors for use in pressure flow lines and that provide a signal when a flow rate exceeds a predetermined rate and in particular relates to a differential pressure flow sensor utilizing first and second thin metallic sections, the first section having one of several planar shapes and the second section being formed of two parallel conductor arms, the two sections being detachably connected to each other to form a flow sensor switch having a normally closed electrically conductive switch path, the flow sensor being mounted in a common plane between first and second annular insulative support members or rings across a central opening defining a flow passageway such that a predetermined flow in the pressure flow line detaches the first and second metallic sections from each other to open the normally closed switch and provide an indication of an open conductive path.

2. Description of Related Art

A commonly assigned copending application filed of even date herewith, incorporated by reference herein in its entirety, and entitled "Differential Pressure Flow Sensor Using Multiple Layers of Flexible Membranes" describes a differential pressure flow sensor for use in very low pressure flow lines that includes at least first and second layers of flexible plastic membranes mounted on a support member and extending across the central flow passageway of the very low pressure line. The at least first and second layers of the flexible plastic membranes are in loose-fitting superimposed relationship with respect to each other to provide a membrane discontinuity and allow a predetermined bleed flow rate therethrough. An electrically conductive strip of flexible material is placed in juxtaposed relationship with the at least first and second layers of flexible plastic membrane. First and second electrical contacts are formed as part of the conductive strip for providing an indication of a closed or open conductive switch path through the conductive strip. In order to accomplish this indication, the conductive strip has a normally closed switch portion completing an electrical circuit between the first and second contacts, the switch being opened when the flow rate in the line exceeds the bleed flow rate through the at least first and second membranes with the very low flow pressure against the membranes opening the switch contacts to provide an indication of an open conductive path. Such a sensor is commonly known as a "slip-joint" type of sensor. The sensor as disclosed in the commonly assigned copending application, as stated, opens by the flow pressure forcing the membranes against one portion of the "slip-joint" conductive strip thus separating the electrical contacts and opening the circuit.

Another prior art type "slip-joint" type of sensor has a first outer annular support ring, an annular metallic conductive ring, an insulated center annular support ring, a second annular metallic conductive ring, and a fifth outer insulated support ring. The switch portion is formed of first and second elongated metallic sections one of which has an outer end connected to the first one of the metallic annular rings and a second portion having an outer end connected to the second spaced metallic annular ring. The second portion has a U-shaped inner end that slidably receives a flat inner end of the first section thus forming switch contacts. The conductors are connected to the first and second annular metallic rings to provide an indication of an open switch.

Such a sensor is important because it has a relatively large flow-through area with only the metallic switch in the flow path to detect the pressure flow. However, they require relatively high flow rates and high pressure differentials to operate. In addition, one end of the elongated metallic switch is electrically attached to one of the annular metallic rings in one plane and the other end is electrically attached to the other of the annular metallic rings in a second plane separated from the first annular metallic ring by an insulating member. Thus, these sensors are expensive because they require full diameter annular sheet metal rings spaced from each other by an insulated annular ring and to which the ends of the switch portion are connected.

It would be advantageous to have a "slip-joint" type of sensor without either membranes being required or without requiring the electrical contacts to electrically connect a first metallic annular ring in a first plane and a second metallic annular ring in a spaced second plane.

SUMMARY OF THE INVENTION

The present invention discloses an improved differential pressure flow sensor for use in pressure flow lines that includes first and second spaced, insulated, annular support members or rings sealed in a flow line and having a central opening defining a flow passageway. First and second thin elongated metallic sections, one of which has one of a plurality of planar shapes and is detachably connected to the other, form a flow sensor switch having a normally closed electrically conductive switch path. The flow sensor is mounted in a common plane between the first and second annular support members across the central opening such that a predetermined flow in the pressure flow line separates the first and second thin elongated metallic sections from each other to open the normally closed switch and provide an indication of an open electrically conductive path. Thus, there is no need in this embodiment for expensive, full diameter sheet metal annular conductive rings. Further, there is no need for membranes to be placed across the flow passageway.

In addition, as stated, the sensor switch body may take on a variety of planar shapes depending on the flow rate to be permitted without tripping the sensor. Thus the planar shape of the first thin metallic section of the switch may be rectangular. It also may be frustoconical with one end having a narrower width than the other, the narrow end being detachably connected to the second thin metallic section to form the switch contacts and the wider end being mounted between the insulated support rings for stability. Further, the planar shape may be circular and have a diameter either greater than or less than the central opening of the annular insulated support rings. In addition, the planar shape may be polygonal with multiple apexes with at least some of the apexes extending between the first and second annular support members for mounting purposes.

The second thin metallic section of the switch includes first and second conductive arms in fixed spaced relationship with each other, each arm having an outer end and an inner end. Each inner end of each arm detachably engages the first thin metallic section to form the normally closed switch contacts. Each outer end of each arm is adapted to receive an external conductor such that an electrically conductive path is formed through the first and second conductive arms and the first thin metallic section. The path is electrically opened when a predetermined flow magnitude occurs in the flow line and detaches the first and second metallic arms from the first metallic section.

In another embodiment, the first rectangular thin metallic section forming the switch includes a first end mounted between the first and second annular support members and a second end diametrically opposed to the first end in the same common plane, the second end being detachably connected to the inner ends of the first and second conductive arms forming the second thin metallic section. It also has a center arcuate portion bowed outwardly from the common plane that is integrally formed with the first and second ends to form a unidirectional low pressure sensor in the direction of the outward bow.

It will be understood that the width of the rectangular first thin metallic section of the switch, in the common plane, varies the pressure differential and flow magnitude at which the normally closed switch opens.

The normally closed switch includes an inner end on the first thin metallic section in the shape of a flat edge portion that is an electrically conductive surface. The inner end of each of the first and second arms forming the second thin metallic section creates first and second electrical contacts. A U-shaped slot is formed on the inner end of each of the first and second arms for forming the first and second electrical contacts for slidably receiving the conductive surface of the flat edge portion of the first thin metallic section and completing a closed electrical circuit that is opened when the flat conductive surface is slidably removed from the U-shaped slot forming the first and second electrical contacts.

In order to provide dependable continuous contact between the slidable sections, the U-shaped slot on the inner end of each of the first and second arms is uniquely formed. It includes first, second, and third spaced parallel extensions, each having an inner end and an outer end, with each adjacent pair being joined by a substantially U-shaped base at opposite ends. The outer end of a first one of the spaced parallel extensions extends outwardly beyond the corresponding U-shaped base forming the outer end of the second and third parallel extensions. The outwardly extending outer end is bent at an angle toward, and preferably beyond, the plane of the second parallel extension such that the bent outer end forms a spring force when engaging the inserted flat edge portion conductive surface of the first thin metallic section to provide dependable electrical contact with the first metallic section inserted therein until slidable separation is complete.

If desired, an insulated center annular support section may be used for mounting between the first and second annular support rings and has a corresponding central opening. A tab portion extends from the periphery of each outer annular support ring and the annular center support ring in superimposed relationship with each other and each has an outer edge. A first opening extends inwardly from the tab outer edge of the annular center support ring for receiving first and second ones of the external conductors. Second and third spaced parallel openings are formed in the annular center support ring tab that intersect with the first opening for receiving a corresponding outer end of the first and second arms for attachment to the first and second conductors. Further, either a single recess or first and second spaced recesses may be formed extending inwardly from the central portion of the center annular support section for receiving a corresponding inner end of the first and second arms for support thereof as will be discussed more fully hereafter.

In a further embodiment, a film type flexible membrane may be sealingly placed on the outside of one or both sides of the assembly to form a sealed unit through which no pressure can flow. However, the thin flexible nature of the film will allow it to flex under pressure sufficient to open the switch contacts.

Thus, it is an object of the present invention to provide a "slip-joint" type of flow sensor wherein the electrically conductive path is formed of first and second thin metallic sections mounted in a common plane between first and second annular support members across a central opening therein.

It is a further object of the present invention to provide a "slip-joint" sensor in which the sensor body may take on a variety of planar shapes depending on the flow rate to be permitted without tripping the sensor.

It is still another object of the present invention to provide a sealed sensor unit with a flexible membrane on at least one side of the sensor unit to prevent pressure flow therethrough but which will allow a predetermined pressure to "flex" the membrane sufficient to open the switch contacts.

Thus, the invention relates to a differential flow pressure sensor for use in a pressure flow line including first and second spaced, insulated, annular support members sealed in the flow line and having a central opening defining a flow passageway, first and second thin metallic sections having a planar shape and being detachably connected to each other to form a flow sensor switch having a normally closed electrically conductive switch path, and the flow sensor being mounted in a common plane between the first and second annular support members across the central opening such that a predetermined low pressure, low flow in the pressure flow line detaches the first and second metallic sections from each other to open the normally closed switch and provide an indication of an open electrically conductive path.

BRIEF DESCRIPTION OF THE DRAWINGS

These and other features of the present invention will be more fully disclosed in the following DETAILED DESCRIPTION OF THE INVENTION in which like numerals represent like elements and in which:

FIG. 11 taken along lines 11—11; with—FIG. 11 taken along lines 12—12;

DETAILED DESCRIPTION OF THE INVENTION

Figure 1:
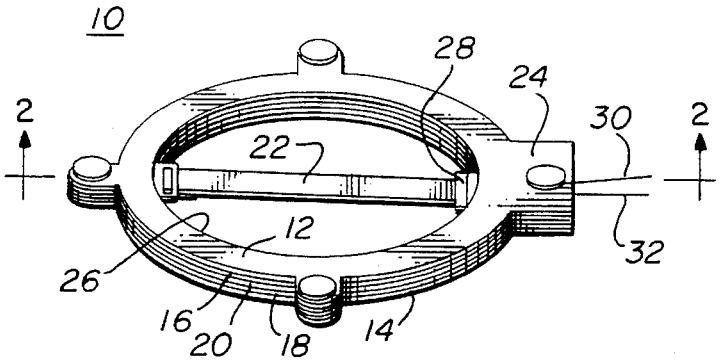
FIG. 1 PRIOR ART
FIG. 1 is an isometric view of a prior art "slip-joint" type low pressure flow sensor.
Figure 2:
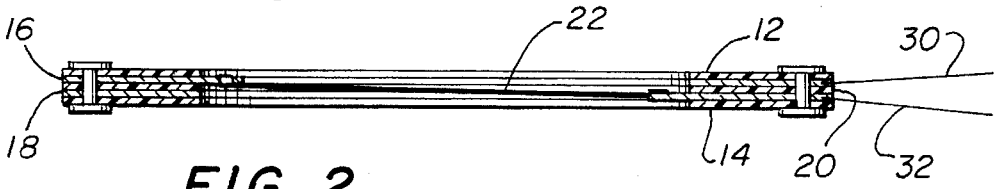
FIG. 2 PRIOR ART
FIG. 2 is a cross-sectional exploded view of the "slip-joint" type prior art low pressure sensor of FIG. 1.
Figure 3:
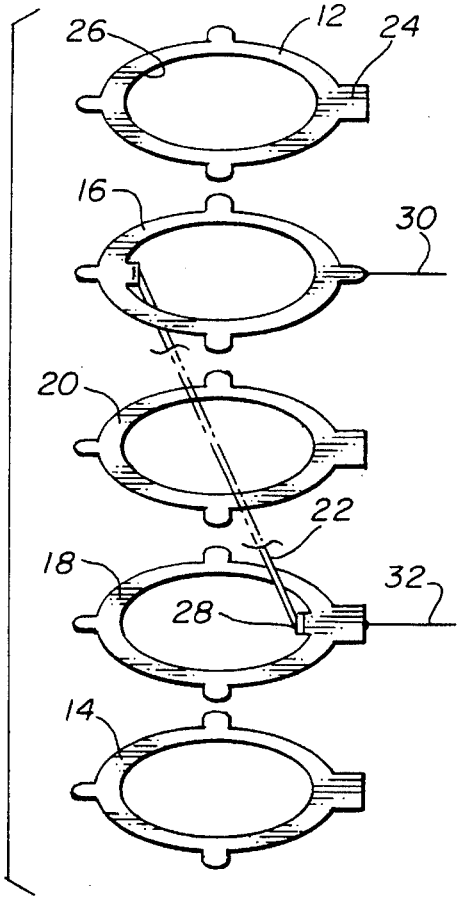
FIG. 3 PRIOR ART
FIG. 3 is an exploded isometric view of the prior art "slip-joint" type sensor and switch illustrating the requirement that the switch element connect an annular metallic ring in one plane to a second annular metallic ring in a second plane, the two rings being separated by an insulated annular spacer ring.

FIG. 1 is an isometric view of a current "slip-joint" type of sensor that requires relatively high flow rates and high pressure differentials to operate. FIG. 1 is an example of an existing design. The unit 10 includes outer insulated rings 12 and 14, inner sheet metal annular rings 16 and 18 that are separated by an innermost insulated annular ring 20. Each metal ring has an electrical conductor 30, 32 connected thereto, respectively. A "slip-joint" type sensor 22 has one end attached to metal ring 16 and the other end attached to metal ring 18. This is best shown in FIG. 2 and FIG. 3. Thus there is a conductive electrical path through conductor 30, metal ring 16, metal "slip-joint" connector 22, metal annular ring 18, and conductor 32. It is apparent that one end of the connector 22 is in one plane with metal annular ring 16 while the other end is in another plane spaced from the first plane and connected to metal annular ring 18. The conductor 22 is formed into two pieces that are connected by a "slip-joint" at 28. Thus, one portion of the conductor has a U-shaped end into which is slidably engaged the inner end of the other portion as is well known in the art.

FIG. 2 illustrates a cross-sectional view taken along lines 2—2 of FIG. 1 while FIG. 3 is an exploded view to illustrate clearly the parts thereof. At least the two outer and the inner insulative rings have an extended tab 24 attached thereto in superimposed relationship for mounting the electrical leads 30 and 32. Thus the tab design of the prior art requires two completely annular conductive metal rings which are expensive to make especially in larger sizes. In addition, the "slip-joint" type connector does not lie in a common plane at both ends. Thus one end is in one plane and the other end is in another plane. Clearly the construction is made more difficult and expensive and the pressure forces requiring the "slip-joint" to open and create an open electrical circuit varies depending upon which side of the sensor faces the flow.

Figure 4A:
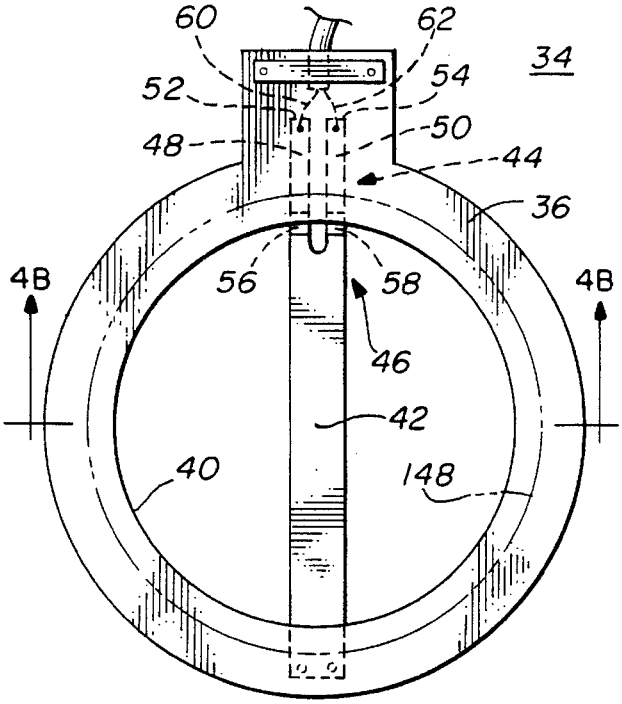
FIG. 4A is a plan view of a first embodiment of the present invention.

The differential flow pressure sensor 34 shown in FIG. 4A overcomes the disadvantages of the prior art. It includes first and second spaced, insulated, annular support members 36 and 38, most clearly seen in the cross-sectional view of FIG. 4B, the annular support members 36 and 38 being sealed in the flow line and having a central opening 40 defining a flow passageway. First and second thin metallic sections 42 and 44, having a predetermined planar shape, are detachably connected to each other at 46 in a manner to be more clearly shown hereafter to form a flow sensor switch having a normally closed electrically conductive switch path. The flow sensor 34 switch sections 42 and 44 are mounted in a common plane between the first and second annular support members 36 and 38 across the central opening 40 such that a relatively low pressure flow in the pressure flow line forces the first metallic section 42 away from second metallic section 44 to open the normally closed switch contacts and provide an indication of an open conductive path. It will be noted in FIG. 4A that the planar shape of the first thin metallic section 42 is rectangular.

The second thin metallic section 44 includes first and second conductive arms 48 and 50 in fixed spaced parallel relationship to each other. Each arm 48 and 50 has an outer end 52 and 54, respectively, and an inner end 56 and 58, respectively. Each inner end 56 and 58 of each arm 48 and 50 extends at least partially into the flow passageway or central open 40 and detachably engages the inner end of the first thin metallic section 42 to form the normally closed first and second switch contacts. Each outer end 52 and 54 of each corresponding arm 48 and 50 is adapted to receive an electrical conductor 60 or 62 to form an electrically conductive path through the first and second conductive arms 48 and 50, first and second switch contacts 56 and 58 and the first section 42. The path is opened when a predetermined flow magnitude occurs in the flow line and detaches or separates the first and second switch contacts 56 and 58 of metallic arms 48 and 50 from the first metallic section 42.

As stated earlier, the planar shape of the first thin metallic section 42 in plan view is rectangular, as can be seen in FIG. 4A.

Figure 4B:
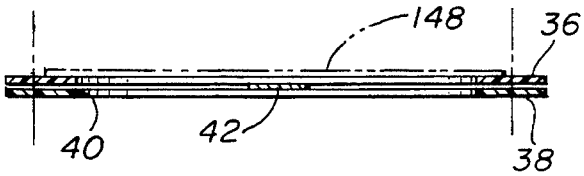
FIG. 4B is a cross-sectional view of the first embodiment shown in FIG, 4A and taken along lines 4B—4B.
Figure 4C:
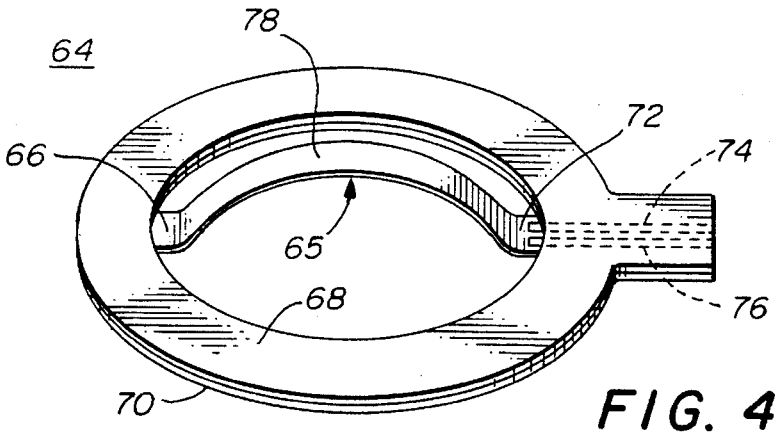
FIG. 4C is an isometric view of a second embodiment of the present invention.
Figure 4D:
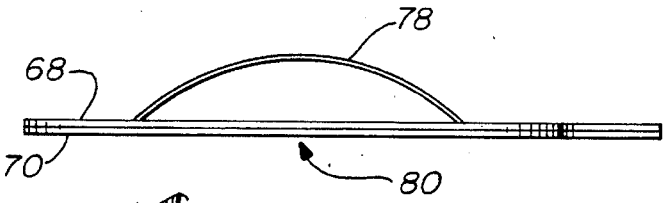
FIG. 4D is a side view of the second embodiment of the sensor shown in FIG. 4B.

A second embodiment of the differential flow pressure sensor having a planar rectangular shape only in plan view is illustrated in FIG. 4C and 4D. The flow sensor 64 has a thin rectangular metallic section 65 in plan view that includes a first end 66 mounted between the first and second annular support members 68 and 70 and a second end 72 diametrically opposed to the first end 66 in a common plane and being detachably connected to the first and second spaced arms 74 and 76 forming the second thin metallic section (shown in phantom lines) substantially as described previously in relation to FIG. 4A. An arcuate center portion 78 bows outwardly from the common plane and is integrally formed with the first and second ends 66 and 72 to form a unidirectional low pressure high flow sensor in the direction of the outward bow as indicated by arrow 80.

FIG. 4D is a side view of the second embodiment illustrating the outward bow of the first section of the thin rectangular metallic section.

Figure 5:
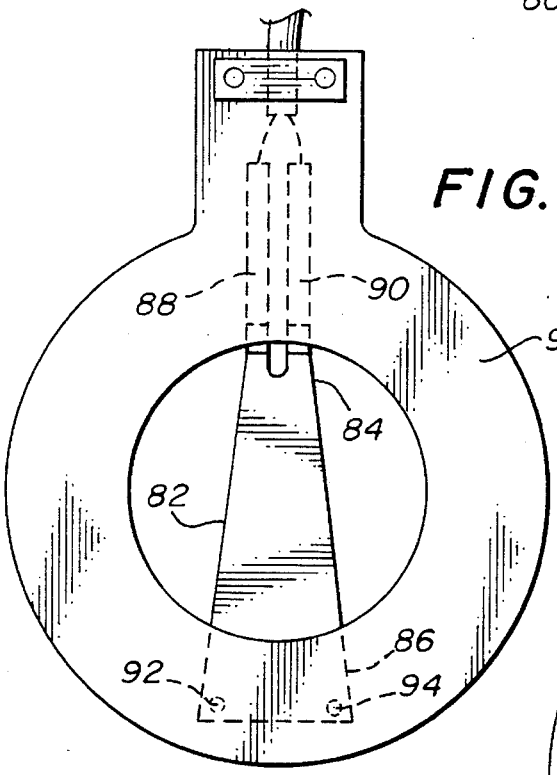
FIG. 5 is a plan view of a third embodiment of the present invention.

FIG. 5 is a plan view of an embodiment in which the planar shape of the first thin metallic section 82 is frustoconical with one end 84 having a narrower width than the other end 86. The narrow end 84 is detachably connected to the second thin metallic section formed of the parallel spaced metallic arms 88 and 90 as explained earlier. This embodiment allows a greater force to hold the end 86 of the section 82 between the first and second annular support members 68 and 70 to prevent the thin metallic section 82 from fragmenting and entering the flow line.

It is noted that orifices 92 and 94 are formed in the outer end 86 of the thin metallic section 82 to help maintain the metallic section 82 between the two insulated rings one of which, 96, is shown in the plan view. Under pressure, the material of the insulating rings 96 enters the orifices 92 and 94 to lock the outer end 86 of the thin metallic section 82 in place between the annular insulating support rings.

Figure 6:
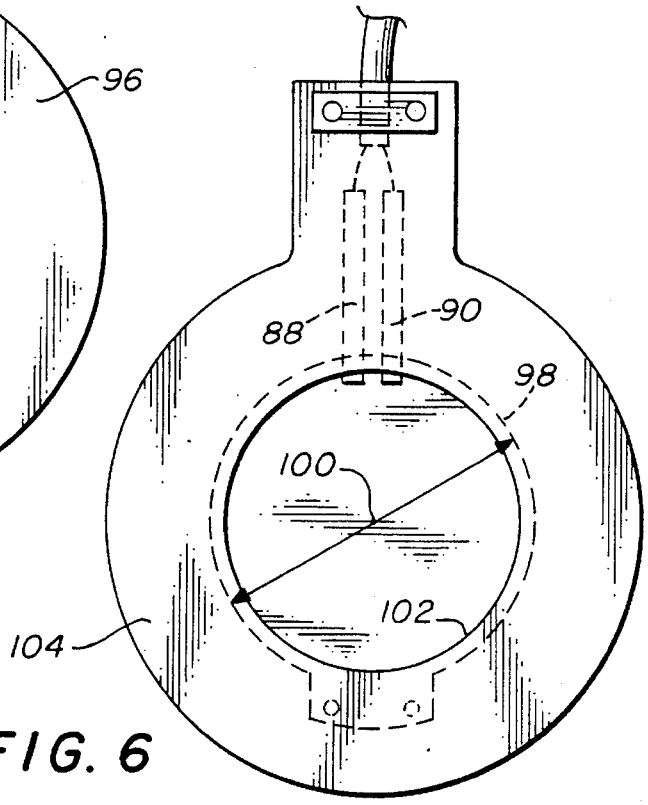
FIG. 6 is a plan view of a fourth embodiment of the present invention.
Figure 10:
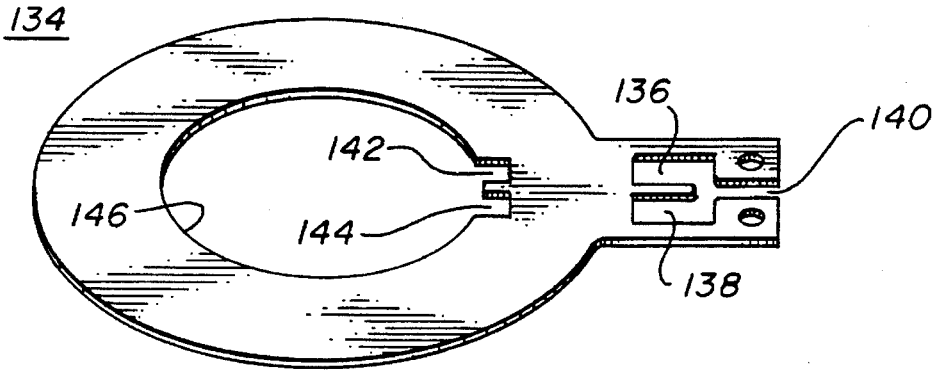
FIG. 10 is an isometric view of an alternate center insulated annular support ring having recesses therein for mounting electrical contact arms.

FIG. 6 illustrates a lower differential pressure flow sensor embodiment in which the planar shape of the first thin metallic section 98 is circular. The diameter of the thin circular metallic section 98 may be greater or less than the central opening 102 of the insulated support rings one of which, 104, is shown in the plan view in FIG. 6. Obviously, by varying the ratio of the diameter of section 98 and central opening 102, the flow rate at which the switch opens is varied. If the diameter 100 of the thin metallic section 98 is greater than the diameter of the central opening 102 as shown by phantom lines in FIG. 6, then the insulated support rings 104 must be separated by a third insulated support member 134 as shown in FIG. 10. The central opening of the third support member 134 is larger in diameter than the central opening 102 of the outer support rings 104. The space provided allows the thin metallic section 98 to pull out from between the outer support members to open the switch contacts upon sufficient pressure being applied.

Figure 7:
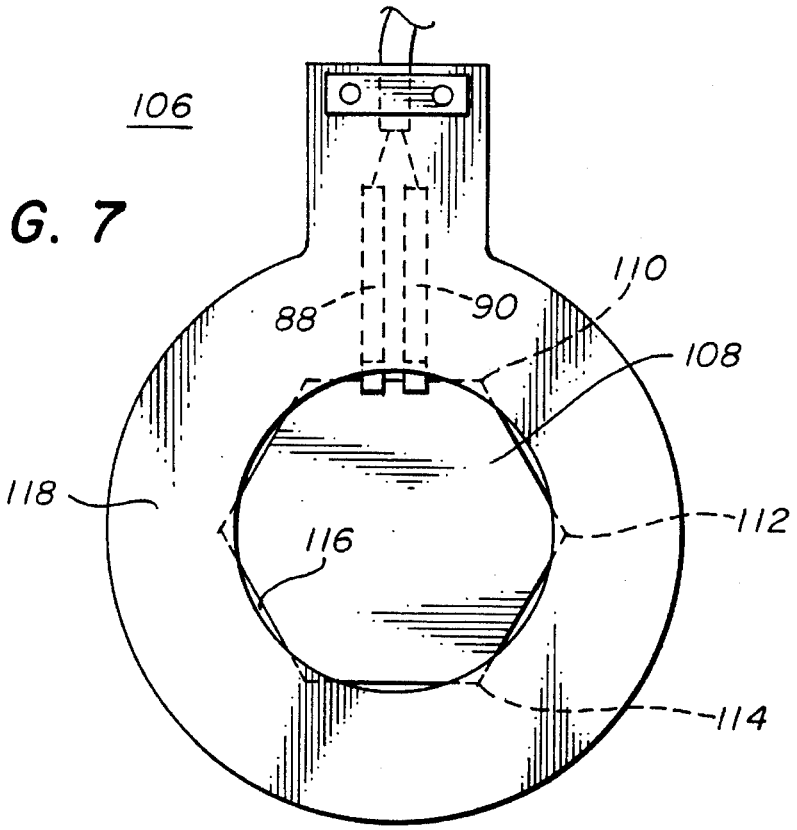
FIG. 7 is a plan view of a fifth embodiment of the present invention.

FIG. 7 also illustrates a lower differential flow pressure sensor 106 in which the planar shape of the first thin metallic section 108 is polygonal with multiple apexes 110, 112, 114, and the like with at least some of said apexes extending between the first and second support members 118 for mounting. In this case the third insulating member is required as a spacer as explained earlier. There may be spaces 116 between the annular support ring 118 and the polygonal thin metallic section 108. Thus by varying the polygonal shape (e.g., 3, 4, 5, or more sides), the area of the spaces 116 can be varied thus, again, varying the flow rate. Otherwise, the unit functions as those previously described.

Figure 8:
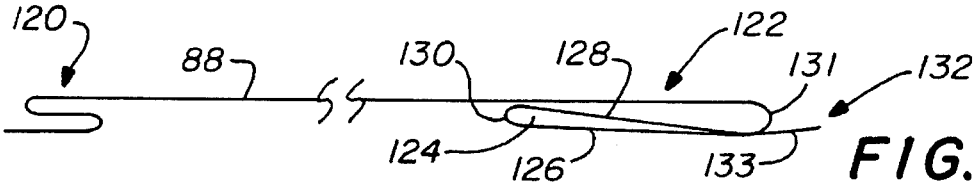
FIG. 8 is a side view of a switch connector arm of the present invention.

FIG. 8 is a side view of one of the first and conductive arms 88 and 90 shown, for example, in fixed spaced relationship in FIG. 7. Thus as can be seen in FIG. 8, arm 88 has an outer end 120 and an inner end 122. The outer end 120 is formed of three folds as shown to provide an attachment area for the electrical cords 60 or 62 shown in FIG. 4A. Each inner end 122 of each arm 88 and 90 detachably engages the first thin metallic section such as the octagonal section 108 in FIG. 7 as shown. This forms the normally closed switch. Considering FIG. 7, the current flows through arm 88, polygonal plate 108, arm 90, and back out through the electrical conductors. When pressure is applied to the polygonal plate 108 and separates the plate 108 from the conductors 88 and 90, the current is interrupted and a signal is provided by the open circuit. Thus each outer end 120 of each arm 88 and 90 is adapted to receive an external conductor such that an electrically conductive path is formed through the first and second conductive arms 88 and 90, and the edge portion of the thin metallic section having the planar shape, the path being opened when a predetermined flow magnitude occurs in the flow line and detaches or separates the first and second metallic arms from the edge portion of the first metallic section.

Figure 9:
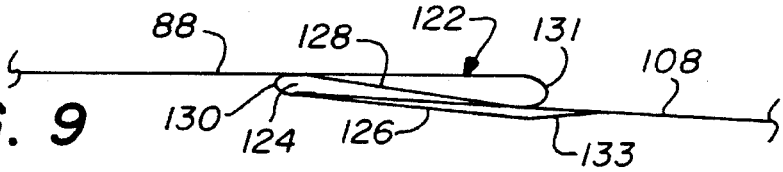
FIG. 9 is an enlarged view of one end of the connector arm in FIG. 8 illustrating the unique construction thereof that provides a positive contact between the U-shaped end and a flat electrically conductive portion inserted therein.

In FIG. 8, a U-shaped slot 124 is formed on the inner end 122 of each of the first and second arm extensions 88 and 90 for forming the first and second electrical contacts for slidably receiving the flat edge portion of the first thin metallic portion such as the polygonal metal plate 108 that forms the connecting portion to the electrical contacts and completes the closed electrical circuit that is opened when the flat first electrical contact 108 is slidably removed from the U-shaped slot 124 forming the first and second electrical contacts on the inner end of arms 88 and 90. The U-shaped slot 124 includes first and second spaced parallel extensions 126 and 128 being joined by a substantially U-shaped base 130 at the inner ends thereof. Parallel arm extensions 122 and 128 are joined by a U-shaped base 131 at the outer ends thereof. The outer end 132 of the parallel arm extension 126 extends outwardly beyond the U-shaped base 131 of the parallel arms 122 and 128. The outer extending portion 133 is bent at an angle toward the plane of the arm extension 128 such that the bent outer end 133 forms a spring force when engaging the inserted flat edge portion such as 108 as shown in FIG. 9. Thus it provides a dependable spring force electrical contact with the inserted plate 108 until slidable separation is complete. As can be seen in both FIGS. 8 and 9, the outer end 122 of arm 88 is folded back over itself to form U-shaped base 131 and parallel arm 128. Parallel arm 128 is then folded in the opposite direction over itself to form U-shaped base 130 and parallel extension 126 having an outer end 133 that extends beyond the outer end 131 of arm 88. It can be seen that to insert the contact arm 108 in the U-shaped slot 124, spring arm 126 must be spread apart from arm extension 128 and connector 108 inserted therein. The spring action or force of arm 126 with extension 133 will provide a positive electrical contact with inserted arm 108. That contact will remain constant until the arm 108 is completely separated from arm 88. Thus positive electrical contact is made with this construction at all times.

Figure 13:
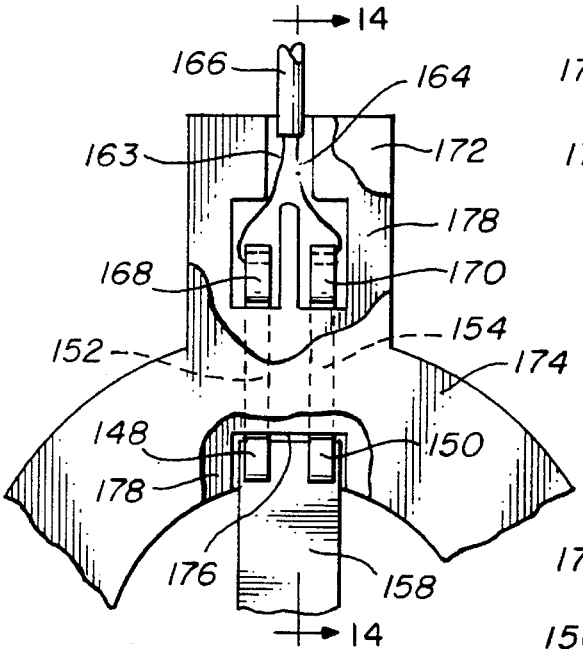
FIG. 13 is a partial plan view of a flow sensor of the present invention in which the switch contacts are entirely between the first and second insulative support members and are located in recesses in a third insulative support member that separates the first and second insulative support members.

FIG. 10 is a plan view of an inner gasket for the sensor that may be optionally added as explained earlier when the thin metallic membrane extends between the two outer support members. The sensor gasket 134 shown in FIG. 10 has also been described previously in commonly assigned copending application Ser. No. 08/566312 filed concurrently with this application. Its purpose as described therein is to provide cavities 136, 138, and 140 for the insertion of the electrical leads and the contacts to the arms 88 and 90 shown in FIG. 7 or, of course, any of the other corresponding arms shown in the other figures as well as having recesses 142 and 144 on the inner periphery 146 where the inner ends of arms 88 and 90 shown in FIG. 7 can make contact with the other metallic section to form the switch contacts. Epoxy can be placed in the cavities 136, 138, and 140 when the electrical leads are placed therein. If desired, the center portion between recesses 142 and 144 may be removed to form "one" large recess as shown in FIG. 13. A complete discussion of the inner gasket 134 can be found in the commonly assigned copending application.

Figure 11:
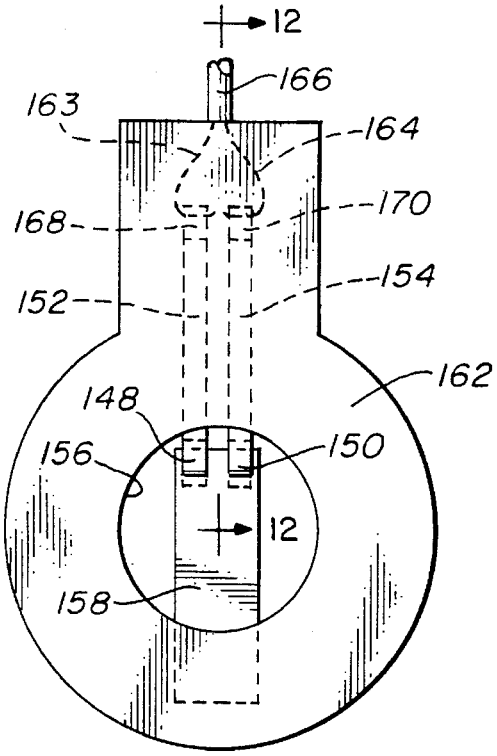
FIG. 11 is a partial plan view of a flow sensor of the present invention in which the switch contacts are exposed entirely within the central opening defining the flow passageway.
Figure 12:
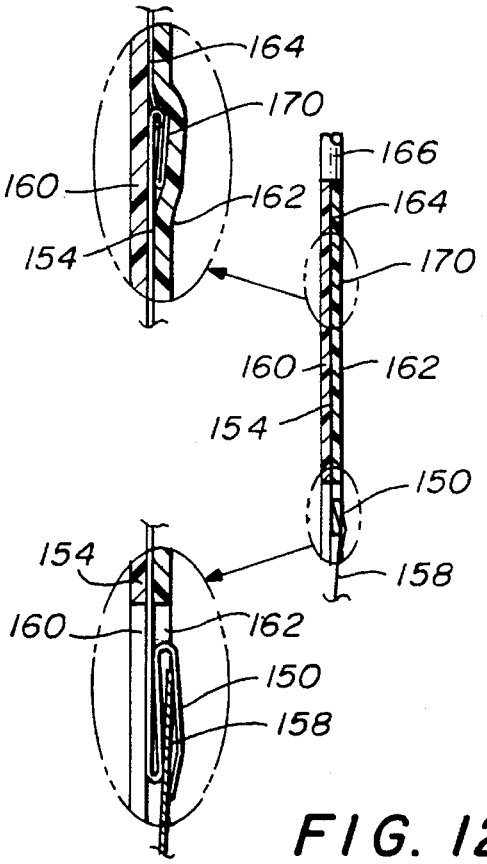

FIG. 11 is a partial plan view of a flow sensor of the present invention showing the switch contacts 148 and 150 of parallel conductive arms 152 and 154 extending entirely within the central opening 156 to make electrical contact with the end of the first switch portion 158. Parallel conductive arms 152 and 154 lie between the outer insulating support members 160 and 162 as shown in the cross section of FIG. 12. Electrical wires 163 and 164 extend from cable 166 and are connected to the outer ends 168 and 170 of conductive arms 152 and 154. The connections 168 and 170 and wires 163 and 164 may be sealed between the outer insulating support layers 160 and 162 with epoxy in a conventional manner. Because the wires 163 and 164 and conductive arms 152 and 154 are so thin, very little space is required between the outer support layers 160 and 162.

FIG. 13 is a partial plan view of a flow sensor of the present invention showing the switch contacts 168 and 170 entirely between the outer support layers 172 and 174. A single notch or recess 176 is formed in the center or third support member 178 as shown. Otherwise the unit functions as described previously.

Figure 14:
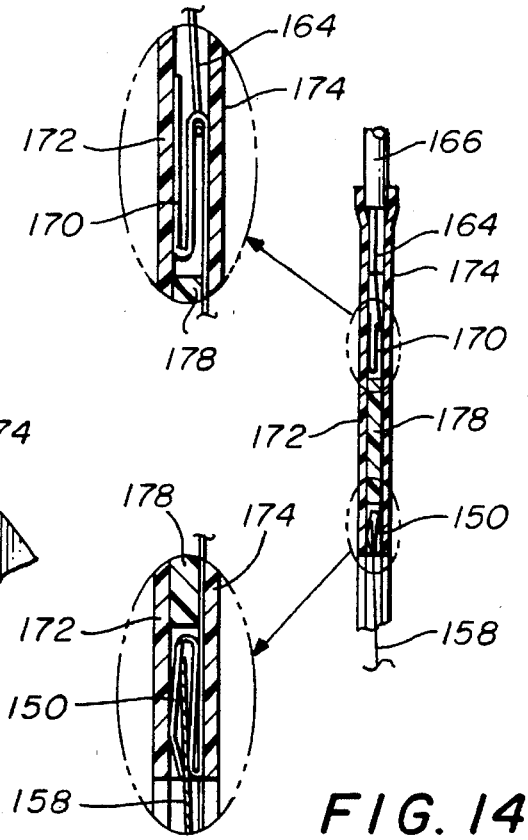
FIG. 14 is a cross-sectional view of the flow sensor of FIG. 13 taken along lines 14—14.

FIG. 14 is a cross-sectional view of FIG. 13 taken along lines 14—14.

Thus there has been disclosed a "slip-joint" type of sensor which differs from the prior art "slip-joint" type sensors in that the metallic sensor is formed of two sections slidably joined together to form switch contacts and where the two sections of the switch lie in a common plane and are mounted in that common plane between two insulated annular support rings. Further, the metallic switch elements, because they lie in a common plane, do not have to be formed with annular metal rings the first of which is one plane and the second of which is in a second plane separated from the first ring with an insulating ring and wherein one end of the switch is attached to one ring in one plane and the other end of the switch is attached to the other ring in the other plane. Thus the present switch is much more economical and simple to produce.

In one further alternate embodiment of the present invention, if desired, a film 184 may be sealingly placed on the outside of one or both sides of the assembly as shown by the phantom line 148 in FIG. 4B and as outlined by the phantom line 148 in FIG. 4A. In this unit, the switch then forms a sealed unit through which no pressure can flow. However, because of the thin nature of the film, it is flexible and will allow a pressure applied thereto to separate the switch elements as described previously without allowing fluid flow therethrough.

Thus the embodiment of the sensor illustrated in FIGS. 4C and 4D is a relatively low pressure high flow unidirectional sensor. The thickness of the metal conductors is approximately six thousandths inch (0.006 inch). Other embodiments illustrated in FIGS. 6 and 7 are low pressure, low flow, bi-directional sensors and the metal switch elements in that case are approximately 0.001 inch thick. They handle low flow of approximately 2 to 5 cubic feet per minute while the embodiment shown in FIGS. 4C and 4D is used in high flow arrangements in the nature of 100–200 cubic feet per minute depending upon the width of the metallic sensor. Thus the present design utilizing the novel tab illustrated in FIGS. 8 and 9 permits easy manufacture. The contacts have low resistance to sliding forces while providing reliable electrical contact. The unique tab and body design provides positive electrical contact without the need for costly, full diameter sheet metal rings. The sensor body may take on a variety of shapes depending on the flow rate to be permitted without tripping the sensor. This sensor may be hermetically sealed by a thin-film polymer liner to permit no flow through the sensor without a signal. This liner may be on either or both sides. The design also permits use of a liner designed to withstand a static pressure without bursting. At this static pressure, however, the liners will be deformed sufficiently to trip the sensor.

This design of the present invention offers the option of operation with very low flow rates and pressure differentials. Low flow rate sensor bodies of the invention may have circular or polygonal shapes engaged with the periphery between overlapping gasket inside diameters. Higher flow rates may be accommodated by varying the thickness of the metallic portions or sections that form the switch connections. Lower cost as a result of eliminating the full diameter rings is also an advantage. In addition, this design allows manufacture of the sensor body and tabs with straight cuts made by hand shears or paper cutters.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

I claim:

1. A flow pressure sensor for use in a pressure flow line including:

only first and second annular insulated support rings in abutting superimposed relationship for mounting in the flow line, each of the annular insulated support rings having an open center portion defining a central flow passageway;

a thin metallic flow sensor having a planar shape and extending in a common plane across the open center portion and having a first end mounted between the first and second annular insulating rings on one side of the open center portion and a second end mounted in said common plane between the first and second annular insulating rings on the opposite side of the open center portion;

the thin flat metallic flow sensor having first and second sections, the first section extending at least partially across the open center portion for detachable connection to the second section to form a normally closed switch that opens when a pressure flow of a predetermined magnitude occurs in the flow line; and the planar shape of the first section providing a factor in determining the pressure magnitude at which the normally closed switch opens to provide an indication of an open electrically conductive path.

2. A differential flow pressure sensor for use in a very low pressure flow line including:

first and second insulated annular support members sealed in said flow line and having a central opening defining a flow passageway;

first and second thin metallic sections having a planar shape and being detachably connected to each other to form a flow sensor switch having a normally closed electrically conductive switch path; and said flow sensor switch being mounted in a common plane between first and second annular support members across said central opening such that a predetermined pressure flow in the pressure flow line detaches the first and second metallic sections from each other to open said normally closed switch and provide an indication of an open conductive path.

3. A differential flow pressure sensor as in claim 2 wherein said planar shape of said first thin metallic section is rectangular.

4. A differential flow pressure sensor as in claim 2 wherein said planar shape of said first thin metallic section is frustoconical with one end having a more narrow width than the other, the narrower end being detachably connected to the second thin metallic section.

5. A differential flow pressure sensor as in claim 2 wherein said planar shape of said first thin metallic section is circular.

6. A differential flow pressure sensor as in claim 2 wherein said planar shape of said first thin metallic section is polygonal with multiple apexes, at least some of said apexes extending between said first and second support members for mounting.

7. A differential flow pressure sensor as in claim 5 further including:

an insulated annular spacer between said first and second support members; and said circular metallic section having a diameter greater than the central opening of said insulated annular support member and extending into the space formed by said annular spacer thereby providing a predetermined pressure flow magnitude at which the normally closed switch opens.

8. A differential flow pressure sensor as in claim 2 wherein the second thin metallic section includes:

first and second conductive arms in fixed spaced relationship, each arm having an outer end and an inner end;

each inner end of each arm extending into said central opening and detachably engaging the first thin metallic section to form the normally closed switch; and each outer end of each arm adapted to receive an external conductor such that an electrically conductive path is formed through the first and second conductive arms and the first section, the path being opened when a predetermined flow magnitude occurs in the flow line and detaches the first and second metallic arms from the first metallic section.

9. A differential flow sensor as in claim 3 wherein said rectangular thin metallic section includes:

a first end mounted between said first and second annular support members in one plane;

a second end diametrically opposed to said first end in said one plane as a common plane and being detachably connected to said second thin metallic section; and a center arcuate portion bowed outwardly from said common plane and connecting said first and second ends to form a unidirectional low pressure high flow sensor in the direction of said outward bow.

10. A differential pressure flow sensor as in claim 3 wherein the width of said rectangular first thin metallic section varies the pressure flow magnitude at which the normally closed switch opens.

11. A differential pressure flow sensor as in claim 2 further including:

an insulated annular center support section for mounting between said first and second annular support members and having a central opening with a diameter greater than the central opening of the first and second annular support members;

a tab portion extending from the periphery of each annular support member and said annular center support section in superimposed relationship with each other and having an outer edge;

a first opening extending inwardly from the tab outer edge of said annular center support section for receiving first and second ones of said external conductors; and second and third spaced parallel openings in said annular center support section tab that intersect with said first opening for receiving a corresponding outer end of said first and second arms for attachment to said first and second conductors.

12. A differential pressure flow sensor as in claim 11 further including:

at least one recess extending inwardly in said annular center support section from the central opening thereof for receiving the inner ends of the first and second arms for support thereof entirely between the outer annular support members.

13. A differential pressure flow sensor as in claim 8 wherein said normally closed switch includes:

an inner end on said first thin metallic section forming a flat edge portion that is an electrical conductor;

the inner end of each of said first and second arms forming first and second electrical contacts; and a U-shaped slot on the inner end of each of the first and second arms for forming the first and second electrical contacts for slidably receiving the flat edge portion of the first thin metallic portion forming the electrical conductor and completing a closed electrical circuit that is opened when the flat electrical conductor is slidably removed from the U-shaped slot forming the first and second electrical contacts.

14. A differential pressure flow sensor as in claim 13 wherein said U-shaped slot on the inner end of each of the first and second arms includes:

first and second spaced parallel extensions having an inner end and an outer end and being joined by a substantially U-shaped based at the inner ends; and the outer end of a first one of the spaced parallel extensions extending outwardly beyond the outer end of the second one of the spaced parallel extensions, the outer extending portion being bent at an angle toward the plane of the second parallel extension such that the bent outer end forms a spring force when engaging the inserted flat edge conductive inner end portion of the first thin metallic section to provide dependable electrical contact with said flat edge conductive portion inserted therein until slidable separation is complete.

15. A differential pressure flow sensor as in claim 2 further including:

a thin flexible membrane sealingly attached to at least one of said insulated annular support members over said central opening to form a sealed unit through which pressure does not flow but which will flex sufficiently, when under a predetermined pressure, to separate the first and second thin metallic sections and provide an indication of an open conductive path.

* * * * *